United States Patent [19]

Silverman et al.

[11] Patent Number: 4,472,905

[45] Date of Patent: Sep. 25, 1984

[54] TOY VEHICLE WITH TIMING DEVICE

[75] Inventors: Gary S. Silverman, Novi, Mich.; Robert L. Claussen, Crystal, Minn.

[73] Assignee: Custom Concepts, Incorporated, Minneapolis, Minn.

[21] Appl. No.: 480,393

[22] Filed: Mar. 30, 1983

[51] Int. Cl.[3] ..... A63H 11/10

[52] U.S. Cl. ..... 446/444; 273/86 B; 446/462

[58] Field of Search ..... 46/201, 202, 206, 251, 46/252, 253, 254, 257, 1 K; 273/86 B

[56] References Cited

U.S. PATENT DOCUMENTS 3,387,778 6/1968 Althaus ..... 235/95
3,858,875 1/1975 Nemeth et al. ..... 46/202 X
4,280,300 7/1981 Kulesza et al. ..... 46/204

FOREIGN PATENT DOCUMENTS 833914 3/1952 Fed. Rep. of Germany ..... 46/201
2719666 9/1978 Fed. Rep. of Germany .... 273/86 B

*Primary Examiner*—Mickey Yu
*Attorney, Agent, or Firm*—William L. Huebsch

[57] ABSTRACT

A toy vehicle including an electronic timing mechanism with an elapsed time display that may be manually started and will be stopped via a switch when the front end of the vehicle is actuated by an impact with a vertical surface so that the time required for the vehicle to travel a predetermined distance to the vertical surface may be measured.

10 Claims, 3 Drawing Figures

TOY VEHICLE WITH TIMING DEVICE

TECHNICAL FIELD

This invention relates to devices associated with toy vehicles for determining the time required by the vehicle to move a predetermined distance.

DISCLOSURE OF INVENTION

The present invention provides means carried by a toy vehicle for precisely determining the time required for a toy vehicle to move a predetermined distance.

According to the present invention there is provided a toy vehicle of the type comprising a plurality of wheels rotatably mounted on a frame, and means for driving at least one of the wheels to propel the vehicle front end first along a surface. An electronic timing mechanism including a battery-operated integrated digital timing circuit with an elapsed time display is mounted on the frame, along with the switch means for resetting the time display to zero, for starting, and for stopping the timing circuit. At least the portion of the switch means for stopping the timing circuit is mounted on the front end of the frame and is positioned to be activated by contact with a vertical surface into which the vehicle is propelled at the end of the predetermined distance.

The vehicle can be propelled across any surface such as a floor into any vertical surface such as a wall at the end of the predetermined distance. Preferably, the toy vehicle can be used in combination with a track adapted to guide the vehicle along a predetermined path, and the vertical surface can be provided by a gate mounted along the track for pivotal movement from (1) a normal vertical position in the track (to which the gate may be biased by gravity) at which the gate will be hit by the switch means on the front of the frame to stop the timing circuit as the vehicle moves along the track, and (2) an open position affording movement of the vehicle along the track past the gate, to which open position the gate will be moved by the impact of the vehicle.

BRIEF DESCRIPTION OF DRAWING

The present invention will be further described with reference to the accompanying drawing wherein like numbers refer to like parts in the several views, and wherein.

DETAILED DESCRIPTION

Figure 1:
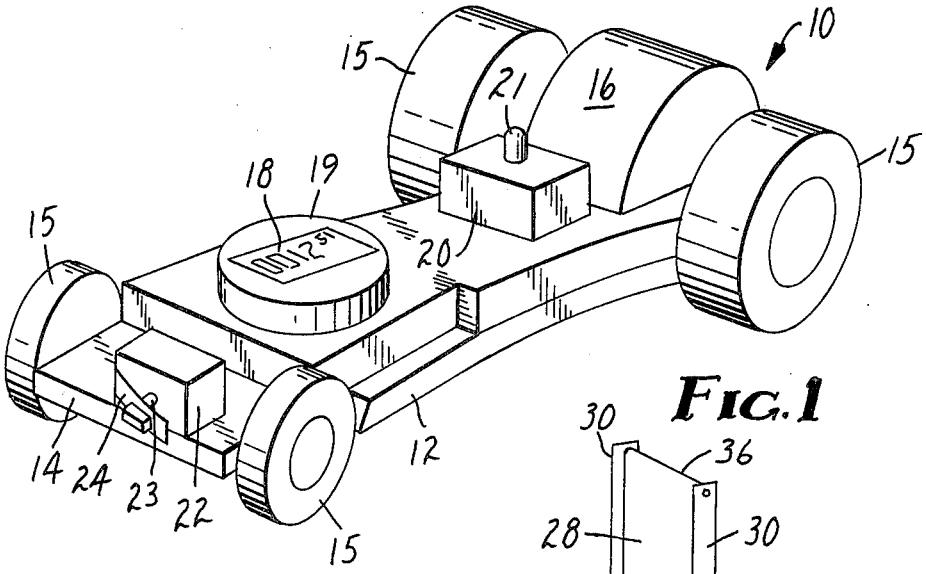
FIG. 1 is a perspective view of a toy vehicle according to the present invention.

Referring now to FIG. 1 there is shown a toy vehicle 10 according to the present invention.

The toy vehicle 10 comprises a frame 12 having a front end 14, four wheels 15 rotatably mounted on axles through the frame 12 adapted for movably supporting the frame 12, and means in the form of a conventional friction or wind-up motor 16 for driving the adjacent pair of wheels 15 to propel the vehicle 10 along a surface with its front end 14 leading. An electronic timing mechanism including a housing 19 containing a battery-operated integrated digital timing circuit with a liquid crystal digital elapsed-time display 18 is mounted on the frame 12. The timing mechanism further includes switch means connected to the circuit in the housing 19 including a first microswitch 20 having an upwardly projecting actuator 21 that can be manually depressed once to reset the timing display 18 to zero and depressed a second time to start the timing circuit; and a second microswitch 22 mounted on the front end 14 of the frame 12 with its actuator 23 projecting outwardly so that the actuator 23 will be depressed to stop the timing circuit when a cantilevered spring 24 extending over the actuator 23 at the front end 14 of the vehicle 10 is bent toward the frame 12 by an impact with a vertical surface.

The housing 19 containing the integrated digital timing circuit with the time display 18 may be any of several such commercially available devices. The housing 19 is frictionally received in a socket defined in the frame 12 with external electrical contacts (not shown) on the housing 19 pressed against electrical contacts on the frame 12 in the socket that are connected by wires to the switches 20 and 22. Thus, if desired, the housing 19 may be removed from the frame 12, and, for example, could be mounted in another frame with other switch means such as for use in the manner of a conventional stop watch.

Figure 2:
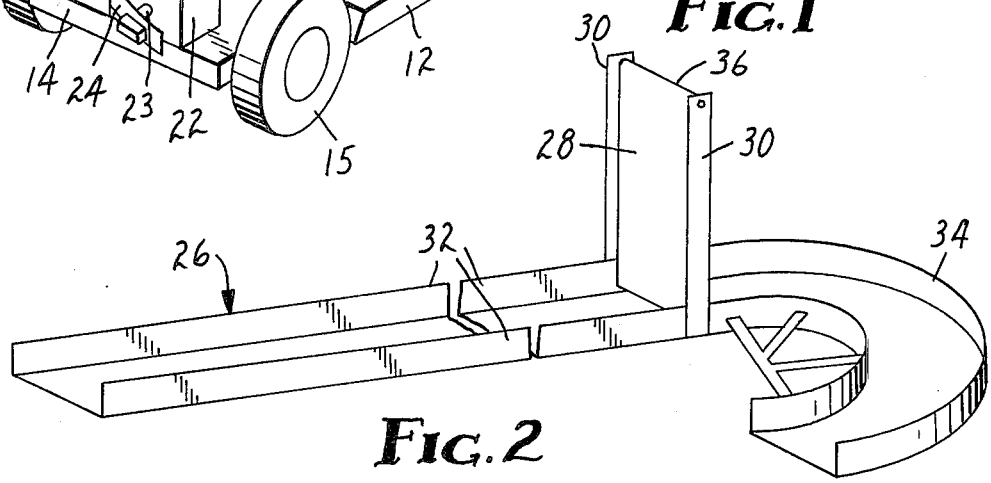
FIG. 2 is a perspective fragmentary view of a track and gate assembly on which the toy vehicle of FIG. 1 may be run.

The toy vehicle 10 may be operated on any surface such as a floor and propelled into any vertical surface, such as the wall of a room. To ensure a consistent path and lessen the impact with the vertical surface, however, it may be preferred to operate the vehicle on a track 26 (FIG. 2) and for the vertical surface to be that of a gate 28 pivotably mounted on two spaced upwardly projecting frame members 30 and positioned across the track 26. The track 26 has vertically extending ridges 32 along its edges to retain the vehicle 10 centrally along the track 26, and may include a banked arcuate portion 34 that can be positioned after the gate 28 to turn the vehicle 10 180 degrees and cause it to return toward the user along the surface on which the track 26 is supported.

The gate 28 is pivotably mounted on the frame members 30 along a horizontal axis 36 at its upper edge so that gravity provides means for biasing the gate 28 to a normal vertical closed position across the track 26. Upon being impacted by the vehicle 10, the lower end portion of the gate will pivot away from the track 26 to an open position at which the vehicle 10 can pass; that impact being sufficient to stop the timing device via actuation of the second microswitch 22. Alternately, the gate 28 could be pivoted along one of its vertical edges or its bottom edge, and could be biased by means such as a spring or a counterweight to its closed position.

To operate the toy vehicle 10, a user first (if necessary) depresses the actuator 21 for the first microswitch 20 to reset the time display 18 to zero. He then energizes the motor 16 (by rotating the drive wheels 15 in the appropriate direction or winding the motor 16 as is required for the type of motor 16 used), depresses the actuator 21 for the first microswitch 20, and places the vehicle 10 on a surface (such as the floor or the track 26) while simultaneously releasing the vehicle 10 and the first microswitch 20. The motor 16 will drive the toy vehicle 10 along that surface and the timing circuit will operate until the actuator 23 on the second microswitch 22 is depressed by an impact with a vertical surface (such as on a wall or the gate 28), at which time the second microswitch 22 will be actuated to stop the timing circuit and a user can read the elapsed time between release and impact with that vertical surface on the time display 18. Two or more of the vehicles 10 may be run in competition with each other, or comparisons may be made between successive runs of the same vehicle 10.

Figure 3:
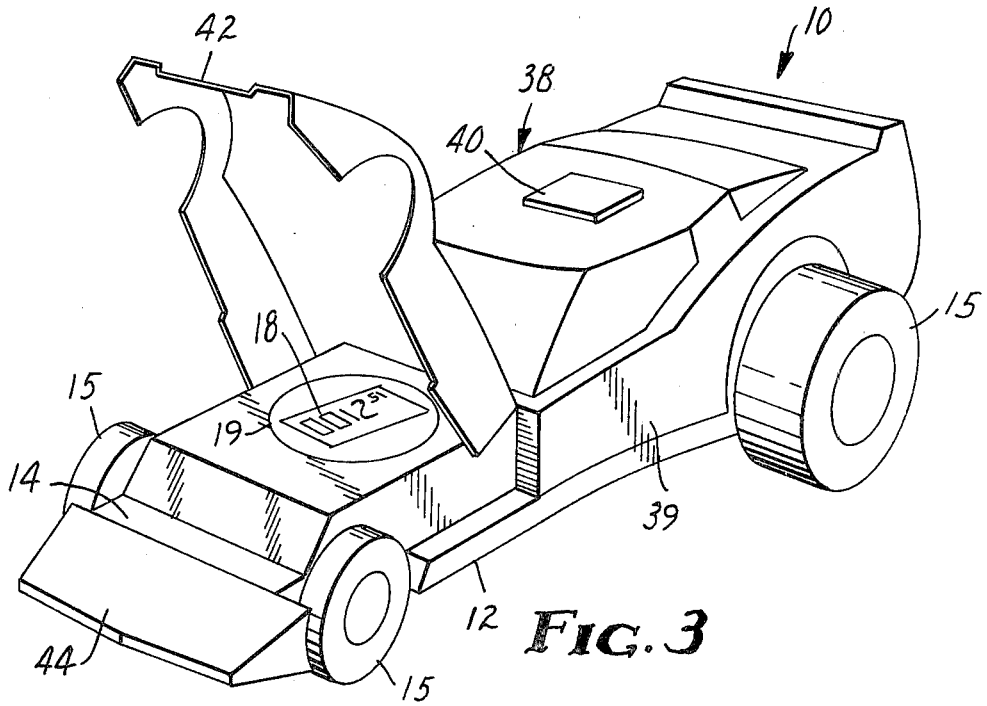
FIG. 3 is a perspective view of the toy vehicle of FIG. 1 to which has been added a decorative body assembly.

FIG. 3 illustrates a decorative body assembly 38 that may be used on the toy vehicle according to the present invention. The body assembly 38, as illustrated, includes a main body portion 39 removably fixed to the frame 12 within which the motor 16 is located, and which locates a depressible button 40 supported on the actuator 21 of the first microswitch 20 which is positioned under the buttom 40. Also included in the body assembly 38 is a hood 42 pivotably mounted on the body portion 39 at one end and under which the housing 19 may be removably positioned with the time display 18 being easily readable when the hood 42 is raised. A bumper 44 is mounted on the frame 12 for horizontal sliding movement, is positioned against the actuator 23 of the second microswitch 22, and will depress the actuator 23 of the second microswitch 22 to stop the timing circuit when the bumper 44 is propelled into a vertical surface, such as that of the gate 28, by movement of the vehicle 10.

It will be appreciated by those skilled in the art that many changes could be made to the toy vehicle described herein without departing from the spirit of the present invention. For example, the switching means could be provided by only one switch mounted on the front end 14 of the frame 12, the vehicle need not include a motor but could be intended to be manually pushed, and different body styles with various moving parts could be used on the toy vehicle 10. Thus the scope of the present invention should not be limited by the structures described herein, but only by the structures described in the dependent claims and their equivalents.

We claim:

1. In a toy vehicle comprising a frame having a front end, and a plurality of wheels rotatably mounted on said frame and adapted for supporting said frame for movement along a surface with said front end leading, the improvement wherein said vehicle further comprises an electronic timing mechanism including an integrated digital timing circuit with an elapsed time display mounted on said frame, switch means mounted on said frame for setting said time display to zero, for starting said timing circuit, and for stopping said timing circuit, and means for operating at least the portion of said switch means for stopping said timing circuit when said vehicle is propelled front end first into a vertical surface.

2. A toy vehicle according to claim 1 wherein said timing circuit and said time display are in a housing removably mounted on said frame.

3. A toy vehicle according to claim 1 wherein the portions of the switch means for setting said time display to zero and for starting said timing circuit comprise a manually operatable switch mounted on the top portion of said frame.

4. A toy vehicle according to claim 1 wherein said toy vehicle further includes means for driving at least one of said wheels to propel said vehicle along a surface.

5. A toy vehicle according to claim 1 wherein said means for operating at least the portion of said switch means for stopping said timing circuit comprises a microswitch mounted at the front end of said frame.

6. In combination:

a toy vehicle comprising a frame having a front end, a plurality of wheels rotatably mounted on said frame and adapted for supporting said frame for movement with said front end leading, and an electronic timing mechanism, including an integrated digital timing circuit with an elapsed time display mounted on said frame, and switch means mounted on said frame for setting said timing circuit to zero, for starting said timing circuit, and for stopping said timing circuit, and means for operating at least the portion of said switch means for stopping said timing circuit when said vehicle is propelled front end first into a vertical surface;

a track adapted to guide said vehicle along a predetermined path;

a gate; and means for mounting said gate along said track for movement from a closed position across said track at which the gate will be engaged by said vehicle, to an open position affording movement of said vehicle along said track past said gate.

7. A combination according to claim 6 wherein said timing circuit and said time display are in a housing removably mounted on said frame.

8. A combination according to claim 6 wherein the portions of the switch means for setting said time display to zero and for starting said timing circuit comprise a manually operatable switch mounted on the top portion of said frame.

9. A combination according to claim 6 wherein said toy vehicle further includes means for driving at least one of said wheels to propel said vehicle.

10. A combination according to claim 6 wherein said means for operating at least the portion of said switch means for stopping said timing circuit comprises a microswitch mounted at the front end of said frame.

* * * * *